United States Patent [19]

Crespin et al.

[11] Patent Number: 4,610,695

[45] Date of Patent: Sep. 9, 1986

[54] FLUID FUEL MIXTURE BASED ON A PULVERIZED SOLID FUEL, PETROLEUM RESIDUES AND WATER, PROCESS FOR ITS PREPARATION, AND THE USE IN BOILERS AND INDUSTRIAL FURNACES

[75] Inventors: Pierre Crespin, Paris; Francois Guay; Paul H. Galvin, both of Le Havre; Jean-Paul Gouzard, Malmaison, all of France

[73] Assignee: Compagnie Francaise de Raffinage, Paris, France

[21] Appl. No.: 837,327

[22] Filed: Mar. 3, 1986

Related U.S. Application Data

[63] Continuation of Ser. No. 565,962, Dec. 27, 1983, abandoned.

[30] Foreign Application Priority Data

Dec. 27, 1982 [FR] France ..... 82 21822

[51] Int. Cl.[4] ..... C10L 1/32

[52] U.S. Cl. ..... 44/51; 44/61; 44/66; 44/72; 252/311.5; 252/351

[58] Field of Search ..... 44/51, 61, 66, 72; 252/311.5, 351

[56] References Cited

U.S. PATENT DOCUMENTS

| | | | |
|---|---|---|---|
| 1,926,304 | 9/1933 | Pawlikowski | 44/51 |
| 2,620,312 | 12/1952 | Manzer | 44/51 |
| 3,620,698 | 12/1968 | Schlinger et al. | 44/51 |
| 4,392,865 | 7/1983 | Grosse et al. | 44/51 |
| 4,395,266 | 7/1983 | Han | 44/51 |
| 4,441,887 | 4/1984 | Funk | 44/51 |

FOREIGN PATENT DOCUMENTS

| | | | |
|---|---|---|---|
| 50412 | 4/1982 | European Pat. Off. . | |
| 0001770 | of 1865 | United Kingdom | 44/51 |

*Primary Examiner*—William R. Dixon, Jr.
*Assistant Examiner*—Margaret B. Medley
*Attorney, Agent, or Firm*—A. Thomas S. Safford

[57] ABSTRACT

A fluid fuel mixture is formed of a suspension of a pulverized solid fuel and of at least one aqueous phase representing from 15 to 40 percent of the mixture before an optional incorporation of an additive. The mixture can comprise, as a supplement to particle-size fractions of the pulverized solid fuel, or as a replacement for some of these fractions, additional particle-size fractions produced from heavy petroleum residues of a natural or synthetic origin which are solid at the temperature at which the invention is practiced. The fluid fuel mixture may be used, for example, in boilers, industrial furnaces, or gasification reactors.

20 Claims, No Drawings

FLUID FUEL MIXTURE BASED ON A PULVERIZED SOLID FUEL, PETROLEUM RESIDUES AND WATER, PROCESS FOR ITS PREPARATION, AND THE USE IN BOILERS AND INDUSTRIAL FURNACES

This application is a continuation of application Ser. No. 565,962, filed Dec. 27, 1983, now abandoned.

The present invention relates to a liquid fuel based on a solid fuel, such as pulverized natural coal or a pulverized petroleum-based solid fuel, petroleum residues and water and to a process for its preparation.

Much research is going on at present which is aimed at increasing the use of coal as a fuel, particularly for the purpose of reducing the consumption of petroleum hydrocarbons.

This problem has proved to be very difficult to solve, partly because of the drawbacks which the conventional use of coal entails, such as the difficulty of handling, transporting, storing and feeding it, extraction of the residues of combustion, pollution, etc., and partly because the combustion equipment used and its technical environment generally are specifically designed for liquid fuels and not adapted to solid fuels.

This is why it has been sought to develop liquid fuel compositions in which the finely divided coal is in suspension in a liquid or in a suitable liquid mixture.

However, the preparation of such compositions gives rise to numerous problems, particularly with respect to the stability and coal content of the composition. Until now, these problems, which are closely related to one another, have been amenable only to compromise solutions which have proved inadequate for competing with liquid hydrocarbons.

The stability (resistance to sedimentation) of a suspension of pulverized coal in a liquid depends not only on the physical properties of the liquid (density, viscosity, etc.) but also on the percentage of coal in the liquid and on the particle size of the coal.

In many cases, the lower the percentage of coal and the larger the particle size, the poorer the stability of the suspension will be. The preparation of finely pulverized coal in such cases requires costly equipment and entails a relatively high manufacturing cost.

In other cases, the coal used has too high an ash content. Its use as a fuel therefore calls for an ash-removal operation before it is adopted, and the coal particles which result from such an operation then are too small (100 percent of the particles being generally under 40, 30 or 15 microns, depending on the nature of the coal and the dispersion of the ash, after effective ash removal) to permit the preparation of a liquid fuel containing a high percentage of coal. A significant increase in that percentage can be secured conventionally only by the addition of coal fractions of a larger particle size, whose ash content is necessarily higher since ash removal becomes less effective as the particle size increases.

Moreover, a high percentage of liquid in the suspension has the following drawbacks:

When the liquid is water, combustion of the suspension is greatly affected thereby and the thermal efficiency is reduced. It is then occasionally necessary to extract part of the water just ahead of the burner, which obviously has an adverse effect on the economic balance of fuel costs versus the costs of equipment and fuel processing.

When the liquid used is combustible, its cost may considerably reduce the profitability and lessen the appeal of this approach.

In this connection, French patent No. 2,393,053, which proposes a composition comprising coal pulverized to a particle size of less than 40 microns, water, and a dispersing agent, points out that if the mixture must be transported in pipelines, by pumping, for example, a carbon content of not more than about 40 weight percent is indicated so far as the viscosity is concerned.

Moreover, in an article published in "La Rivista dei Combustibili", 35 (1981), No. 9, pp. 385–394, Salvi studied dispersions of pulverized coal in combustible liquids such as fuel oils in oil-in-water emulsions.

According to that article, dispersions in oil of pulverized coal in low concentrations (of the order of 30 weight percent) behave like Newtonian liquids. With solid contents of over 30 percent, the viscosity increases gradually, but with solid contents between 40 and 50 percent it increases sharply.

The article further states that when pulverized coal is added to an oil-in-water emulsion, a stable suspension that behaves like an oil is obtained. The best results have been obtained with 50 parts of pulverized coal of a particle size under 70 microns, 30 parts oil, and 20 parts water.

To increase the amount of coal present in pulverized coal/water suspensions, with or without additives, while maintaining the viscosity in a suitable range, mixtures have been proposed which contain coal in the form of ultrafine particles (under 10 microns) and of coarse particles (ranging in size from 20 to 200 microns) and water incorporating dispersing agents.

In this context, European patent EP-0 050 412 gives several examples showing how suspensions with 63 percent coal can be obtained that are stable with time and exhibit no tendency toward sedimentation.

It is apparent from these examples that the proposed suspensions either have a relatively high liquid content or require the use of well-defined particles sizes of coal. In particular, when it is necessary to prepare fine or ultrafine particle-size fractions, the fuel user is confronted with serious grinding problems whose spreading is difficult to control and which therefore occasion very high costs. Moreover, when fuel mixtures are to be prepared from de-ashed coal whose particles are smaller than 20 microns on completion of the de-ashing operation, the user runs into problems related to the coal concentration in the liquid mixture which he can solve only by incorporating expensive additives or specific particle-size fractions of coal with high ash contents, which detract from the appeal of the mixture.

The present invention seeks to overcome these drawbacks.

To this end, the invention has as its object a liquid fuel in the form of a suspension in an aqueous phase of a pulverized solid fuel, such as a coal of mineral origin or a product obtained from heavy petroleum residues, optionally with at least one additive, which is characterized in that the particle-size composition of the pulverized solid fuel coming from a grinding, screening or de-ashing operation is modified by the addition of particle-size fractions of a product obtained from heavy petroleum residues which are solid at storage temperature, and in that the aqueous phase represents from 15 to 40 weight percent of the liquid fuel.

More particularly, these additional particle-size fractions may be obtained:

(a) Directly, in certain industrial cracking units for petroleum feedstocks.
(b) By pulverization of the petroleum residues, which may be carried out cold, by mechanical grinding, or hot, on the residues in the liquid phase. Liquid pulverization may be aided by means of a gas (for example, air or steam), with the particles then undergoing rapid cooling (quenching in water or air).
(c) By emulsification of heavy petroleum residues (mechanical emulsion, optionally with additives), in which case the emulsion obtained may then be mixed directly with the pulverized coal.

Solid residues (for example, optionally blown asphalts) dispersed in these liquids (very fine particles up to about 5 microns in diameter) may be prepared by grinding or mechanically emulsifying them, optionally with an additive, at a temperature of the order of 135° C., for example, in water of a temperature of about 65° C. when the operation is carried out at atmospheric pressure, and then cooling the mixture so obtained.

The solution proposed by the present invention offers numerous advantages. For example, it permits very precise control of the particle size of the matter added to the pulverized coal, and often of the particle shape factor, which makes it possible to obtain stable suspensions with a higher content of combustible matter. It permits the grinding costs and the capital investments in grinding equipment to be reduced. It makes it possible to reduce the percentage of combustible ashes. It upgrades the heavy petroleum residues, which up to now have been a burden to the refiners. It can be used with existing technologies so far as both the burners and their environment are concerned.

Finally, in the case of compositions comprising ultrafine de-ashed coal and a petroleum product of coarser particle size, it permits making use of the advantage inherent in these fuels in that a product is obtained which overall has a low ash content (de-ashed coal; little ash, if any, in the petroleum product), a low sulfur content (coal is lower in sulfur, and de-ashing removes about half of the sulfur contained in the coal), and a good heating value. Moreover, the ash remaining in the coal is of such size that it is carried away as fly ash with the combustion gases, so that the problem of accumulation of the ash in the furnace, which is difficult to solve in an installation designed to operate with an ash-free fuel, is replaced by the problem of recovery of the ash in the flue gases, which can be done more readily in such installations by means of conventional equipment such as filters, cyclones, precipitators, etc.

So far as the petroleum products which may be used in the solid/water fuel suspensions in accordance with the invention are concerned, these may be:

(a) When used in the form of emulsions:
- Bitumens
- Oxidized asphalts
- Pitch from deasphalting
- Atmospheric residues
- Vacuum residues
- Visbreaking, catalytic cracking, coking hydrocracking residues (b) When used in solid, ground form:
- Asphaltenes
- Cokes from hydrocracking, catalytic cracking, or coking
- Residues of combustion, gasification, or pyrolysis
- Pitch from deasphalting.

Several exemplary processes for preparation of suspensions in accordance with the principles of this invention will now be described, from which other objects, features, and advantages of this invention will become apparent. In this description there are disclosed certain preferred modes of the invention; however, it is to be understood that these modes are not intended to be exhaustive or limiting with respect to the invention. On the contrary, the specific modes discussed hereinafter are given for the purpose of illustration only in order that others, skilled in the art, may fully understand the principles of the invention and the purposes thereof, and the manner of applying it to a practical use so that they may modify and adapt it in various forms each as may best be suited for the conditions of a particular use.

In the case of mixtures which use petroleum residues to provide a lacking or complementary particle-size fraction for the solid/water fuel mixture, that fraction may be:

(a) An ultrafine fraction (of a particle size under 20 microns). In this case, finely divided petroleum residues, such as pitches from deasphalting, or even emulsions of bitumens, are used, and to these pulverized coal is added conventionally (80 percent under 80 microns) along with additional water, in the required proportion. The final mixture may then comprise from 20 to 50 percent petroleum residues, from 30 to 50 percent solid fuel, additional water, and optional additives and stabilizers. Moreover, organic solvents such as alcohols, and particularly methanol or ethanol, may be conventionally substituted for a portion of that water.

(b) An intermediate fraction, for example, the fraction from 20 to 80 microns. In this case, the petroleum residue may advantageously consist of pitch or of petroleum coke.

(c) A coarse fraction. In this case, a pitch may be used in the form of a coarse powder or of an emulsion, in a particle size ranging from 80 to 120 microns, for example, as a constituent of a fluid solid/water fuel mixture containing not more than 50 percent of relatively fine solid fuel.

The additional fractions specified under (a), (b) and (c) above thus make it possible to modify the particle-size composition of pulverized solid fuels such as natural coals, coal-washery sludges, or products obtained from heavy petroleum residues.

Moreover, the additional fractions specified under (b) and (c) are particularly well suited for the preparation of improved solid/water fuels in which the coal component consists of an ultrafine de-ashed coal.

As pointed out above, it is also possible to obtain petroleum-residue particles (of a size under 5 microns) by grinding and by emulsifying these residues in water. These particles may then advantageously make up the ultrafine size fraction lacking in a large number of solid/water fuel suspensions.

Examples 1, 2 and 3 which follow relate to suspensions obtained by mixing of a pitch/water emulsion to which pulverized coal has been added.

EXAMPLE 1

In this example, the suspension is composed of an anionic emulsion comprising 60 weight percent pitch and 40 weight percent of a mixture of water, an additive of the Vinsol type, made by Hercules, an Induline type additive made by Westvaco, and soda, the pH of this emulsion being of the order of 12 to 14. To this emulsion there is added pulverized coal of which 80 weight percent is of a particle size under 80 microns.

It is found that without the addition of the product Lomar D, made by Diamond Shamrock, 36.7 percent coal can be included, the final product remaining pumpable with 75.68 percent combustible matter.

When the additive Lomar D is incorporated, substantially identical results are obtained, and the emulsion is broken at 39.73 percent coal.

EXAMPLE 2

In this example, the suspension is composed of a mixture of pulverized coal of which 80 weight percent is of a particle size under 80 microns, and of a cationic emulsion composed of 60 percent pitch and 40 percent of a mixture of water, Polyram S (made by the French company CECA), and hydrochloric acid.

It is found that with 35 percent pulverized coal the product obtained remains fluid (75 percent combustible matter) at ambient temperature. The emulsion breaks at 45.6 percent pulverized carbon.

EXAMPLE 3

In this example, the same components are used as in Example 2, except that pulverized coal is used in a particle size over 63 microns.

A product is obtained which remains pasty at 47.6 weight percent coal, or 79 percent combustible matter.

EXAMPLE 4

In this example, the suspension is obtained by mixing at ambient temperature a bitumen/water emulsion, prepared hot, and pulverized coal. The emulsion, which is cationic, comprises 60 weight percent bitumen, 40 weight percent water, an additive of the Polyram type, and hydrochloric acid (in the ratio of 6 g Polyram and from 5 to 6 g HCl per kg), the pH of the emulsion ranging from 2 to 4. The pulverized coal used is of the Rietspruit variety, and 80 weight percent of it is of a particle size under 80 microns.

A breaking test of the "break on filling" type is then run on this suspension. It consists of adding pulverized coal of an average particle diameter of the order of 40 microns until a firm paste is obtained. (Breaking of the suspension.)

At 22 percent, which corresponds to 68.8 percent combustible matter in suspension in the water, the suspension still remains fluid. Breaking is observed at 25 percent pulverized coal added.

EXAMPLE 5

In this example, the suspension is prepared as in Example 4, except that instead of being cationic it is rendered anionic by the use of tall oil. Soda (NaOH) is added to obtain a pH of 12.3.

In this case, the breaking test makes it possible to determine that breaking occurs at 17 percent pulverized coal added, which corresponds to a combustible-matter content of 66.8 weight percent.

EXAMPLE 6

In this example, the suspension is obtained by first preparing a paste containing 63 weight percent pulverized coal, water, Polyram S, and hydrochloric acid. A cationic bitumen/water/Polyram S emulsion is then added at ambient temperature, and the following two "fluid" products are obtained: A product (a) comprising 52 percent coal and 10 percent bitumen, that is to say, 62 percent combustible matter, and 37 percent water plus additive; and a product (b) comprising 45 percent coal and 17.4 percent bitumen, or 62.4 percent combustible matter, and 37.6 percent water and additives.

In conclusion, it is apparent that in order to improve the properties of solid/water/petroleum residue fuel suspensions, it is advisable:

(1) To reduce the lipophilic character of the coal, for example, by grafting a lipophilic/hydrophilic additive onto the coal before mixing and by adjusting the pH of the mixture. (If the pH is low, the hydrophilic character of the coal is enhanced.)

(2) To increase the "hardness" of the bitumen or of the pitch so as to reduce the "adhesion" of the petroleum residue to the coal.

(3) To vary the particle size so as to increase the coal concentration in the product. In this connection, it should be noted that by enhancing the bimodal character of the particles present, filling is promoted. (Particle size of the bitumen or of the pitch, is under 10 microns in the emulsion.)

(4) To carry out a preliminary grinding operation of the heavy petroleum residues used.

EXAMPLE 7

A pitch/water emulsion is prepared as in Example 1. To this emulsion there is added ground petroleum coke of which 75 weight percent is of a particle size under 80 microns.

It is found that with 41.2 percent petroleum coke the final product remains fluid. (Brookfield viscosity at 15° C., LV2 spindle at 12 rpm: 2000 centipoises.) The total amount of combustible matter is 75.0 percent.

EXAMPLE 8

In this example, a pitch/water emulsion identical to that of Example 1 is used. To this emulsion there is added ground and screened coal of which 100 weight percent is of a particle size under 40 microns.

It is found that with 38.8 percent coal the final product remains fluid. (Brookfield viscosity at 15° C., LV2 spindle at 12 rpm: 900 centipoises.) The total amount of combustible matter is 70.0 percent.

This procedure is repeated with a de-ashed coal of which 100 weight percent is of a particle size under 40 microns. The final mixture obtained has characteristics similar to the one in the preceding example.

EXAMPLE 9

A mixture of ground petroleum coke, de-ashed coal, and water is prepared by mixing with stirring:

| | |
|---|---|
| An ultrafine de-ashed coal obtained from a coal of the Ermelo type and containing about 0.4 percent sulfur and 3.6 percent ash, of which 90 weight percent is of a particle size under 20 microns: | 17.1 weight percent |
| A ground petroleum coke containing 2 percent sulfur and 0.8 percent ash, of which 80 weight percent is of a particle size under 80 microns: | 44.3 weight percent |
| Water: | 37.8 weight percent |
| Lomar D type additive: | 0.9 weight percent |

A fluid and stable mixture is so obtained whose viscosity at 10° C. is 1300 centipoises. The sulfur content of this mixture is only about 1 percent, and the ash content is also about 1 percent. Its heating value is 4800 kcal/kg.

The invention thus permits solid/water/petroleum residue fuel suspensions to be prepared which may contain as much as 40 percent coal and 76 percent combustible matter when pitch is used. These products are relatively fluid. Their stability may be modified as desired by the use of appropriate additives.

It should be noted that the additives which may be used with coal/water/emulsion mixtures include the following emulsifying agents: The salts of amines or polyamines, for cationic emulsions; and the alkaline soaps of fatty acids, for anionic emulsions.

Combustion tests run with the solid/water/petroleum residue fuel suspensions have produced very good results, with acceptable flame, temperature and flue-gas opacity characteristics. A heating value close to that of coal and a combustion efficiency approaching that of the liquid fuels currently in use are obtained.

While there have been described what are at present considered to be the preferred modes of carrying this invention out, it would be apparent to those skilled in the art that various changes and modifications may be effected therein without departure from the scope and spirit of this invention; it is therefore our aim that the appended claims cover all such variations, changes, and modifications as may fall within the true spirit and scope of this invention.

We claim as our invention:

1. A pumpable fluid fuel mixture, consisting essentially of a suspension of (a) from 70 to 5 weight percent of a pulverized solid fuel of particle size such that 80 percent of the particles are less than 80 microns, wherein said solid fuel is selected from the group consisting of natural coal, de-ashed coal, coal-washery sludge and solid petroleum-based fuel, (b) from 5 to 70 weight percent of a pulverized petroleum residue of particle size up to 120 microns, wherein said petroleum residue is selected from the group consisting of asphaltenes, pitches from hydrocracking and catalytic cracking, residues of combustion, distillation, gasification or pyrolysis, pitches from deasphalting, and oxidized asphalts, and (c) from 15 to 40 weight percent of an aqueous phase such that the suspension has a solid proportion of from 60 to 85 weight percent.

2. A pumpable fluid fuel mixture according to claim 1, wherein said pulverized solid fuel is a coal of mineral origin.

3. A pumpable fluid fuel mixture according to claim 1 wherein said pulverized solid fuel is a product obtained from heavy petroleum residues.

4. A pumpable fluid fuel mixture according to claim 1, wherein said pulverized solid fuel is obtained from at least one of a grinding operation, a screening operation, and a de-ashing operation.

5. A pumpable fluid fuel mixture according to claim 1, wherein 80 percent of the particles of the pulverized petroleum residue have a particle size of less than 20 microns.

6. A pumpable fluid fuel mixture according to claim 1, wherein the pulverized petroleum residue has particle size of from 20 to 80 microns.

7. A pumpable fluid fuel mixture according to claim 1, wherein the pulverized petroleum residue has a particle size of from 80 to 120 microns and the suspension has a solid proportion on the order of 50 percent.

8. A pumpable fluid fuel mixture according to claim 1, wherein the aqueous phase further contains a predetermined proportion of an organic solvent.

9. A pumpable fluid fuel mixture according to claim 8, wherein said organic solvent is an alcohol.

10. A process for the preparation of a pumpable fluid fuel according to claim 1, comprising the steps of producing particle-size fractions from solid petroleum residues for incorporation into said fluid fuel mixture; and incorporating said particle-size fractions into said fluid fuel mixture containing pulverized solid fuels, said solid fuels being selected from one or more of a group consisting of natural coal, de-ashed coal, pulverized solid petroleum-based fuel obtained by pulverization, and pulverized solid petroleum-based fuel obtained by emulsification.

11. A process according to claim 10, further comprising adding to the mixture pulverized petroleum residues, the same being selected from asphaltenes, cokes from hydrocracking, catalytic cracking, or coking, residues of the combustion, residues of gasification, oxidized asphalts, and pitches from deasphalting.

12. A process according to claim 11, wherein said petroleum residues are pulverized cold by mechanical grinding.

13. A process according to claim 11, wherein said petroleum residues are pulverized hot, with the residues in the liquid phase.

14. A process according to claim 13, wherein the hot pulverization of the petroleum residues is aided by a gas, with the particles then undergoing rapid cooling by quenching in one of water and air.

15. A process according to claim 10, wherein said pulverized solid fuel is admixed with an emulsion of petroleum residues, water, and additives.

16. A process according to claim 10, wherein a mixture composed of said solid fuel, water, and an additive is prepared, and an emulsion of petroleum residues, water, and additives is then added to said mixture.

17. A method of using a fuel mixture according to claim 1, comprising supplying the same to one of a boiler and an industrial furnace, and then combusting the fuel mixture.

18. A method of using a fuel mixture according to claim 1, comprising supplying the same to a gasification unit, and gasifying the fuel mixture.

19. A pumpable fluid fuel mixture, comprising a suspension containing (a) from 70 to 5 weight percent of a pulverized solid fuel of particle size such that 80 percent of the particles are less than 80 microns, wherein said solid fuel is selected from the group consisting of natural coal, de-ashed coal, coal-washery sludge and solid petroleum-based fuel, (b) from 5 to 70 weight percent of an emulsion of petroleum residue of particle size up to 120 microns, wherein said petroleum residue is selected from the group consisting of bitumens or pitches from deasphalting, asphalts, oxidized asphalts, atmospheric and vacuum residues, and visbreaking, catalytic cracking or hydrocarbon residues, and wherein said emulsion contains up to 75 percent petroleum residue in water, and (c) a cationic agent and an emulsifying additive selected from the group consisting of salts of amines or of polyamines.

20. A pumpable fluid fuel mixture, comprising a suspension containing (a) from 70 to 5 weight percent of a pulverized solid fuel of particle size such that 80 percent of the particles are less than 80 microns, wherein said solid fuel is selected from the group consisting of natural coal, de-ashed coal, coal-washery sludge and solid petroleum-based fuel, (b) from 5 to 70 weight percent of an emulsion of petroleum residue of particle size up to 120 microns, wherein said petroleum residue is selected from the group consisting of bitumens or pitches from deasphalting, asphalts, oxidized asphalts, atmospheric and vacuum residues, and visbreaking, catalytic cracking or hydrocarbon residues, and wherein said emulsion contains up to 75 percent petroleum residue in water, and (c) an anionic agent and an emulsifying additive selected from the group consisting of alkaline soaps of fatty acids.

* * * * *